US005481834A

United States Patent [19]

Kowalczyk et al.

[11] Patent Number: 5,481,834

[45] Date of Patent: Jan. 9, 1996

[54] FIRE-RATED PANEL

[75] Inventors: Stanley Kowalczyk, Clinton; Todd A. Williams, Janesville; James D. Petzrick, Beloit; Charles E. Williams, Delavan, all of Wis.

[73] Assignee: Hufcor, Inc., Janesville, Wis.

[21] Appl. No.: 224,953

[22] Filed: Apr. 8, 1994

[51] Int. Cl.[6] ..... E06B 9/04

[52] U.S. Cl. ..... 52/64; 52/232; 52/243.1; 52/792.1; 52/793.1; 52/794.1; 52/796.1; 49/321; 160/40; 169/48

[58] Field of Search ..... 52/238.1, 243, 52/241, 592.3, 785, 809, 811, 802, 806, 145, 243.1, 232, 64; 160/40, 196.1, 199; 169/45, 48, 49; 49/321, 316, 315

[56] References Cited

U.S. PATENT DOCUMENTS

| | | | |
|---|---|---|---|
| 33,640 | 11/1861 | Fischel | 49/321 |
| 465,338 | 12/1891 | Brown et al. | 49/321 |
| 1,936,732 | 11/1933 | Renard | 108/1 |
| 2,381,635 | 8/1945 | Baker | 52/241 |
| 2,553,459 | 5/1951 | Klein | 160/196.1 |
| 2,884,779 | 5/1959 | Buergin et al. | 52/241 X |
| 3,050,134 | 8/1962 | Multin | 169/5 |
| 3,111,981 | 11/1963 | Simbulan | 160/40 |
| 3,195,192 | 7/1965 | Neisewander | 160/40 X |
| 3,426,491 | 2/1969 | Gaeth et al. | 52/232 |
| 3,464,172 | 9/1969 | McGee, Jr. | 52/168 |
| 3,535,842 | 10/1970 | Karn | 52/241 |
| 3,775,920 | 12/1973 | Schneller | 52/241 |
| 3,837,126 | 9/1974 | Voiturier | 52/232 X |
| 3,866,376 | 2/1975 | Nelsson | 52/241 |
| 3,910,739 | 11/1959 | Snitker | 52/232 X |
| 4,019,581 | 4/1977 | Diggs | 169/16 |
| 4,083,395 | 4/1978 | Romano | 160/199 |
| 4,282,687 | 8/1981 | Teleskivi | 52/809 X |
| 4,359,097 | 11/1982 | Claussen | 169/61 |
| 4,395,854 | 8/1983 | White et al. | 52/64 |
| 4,484,634 | 11/1984 | Swanson et al. | 169/52 |
| 4,791,993 | 12/1988 | Curran | 169/16 |
| 4,799,349 | 1/1989 | Luckanuck | 52/809 |
| 4,888,918 | 12/1989 | Green et al. | 49/501 |
| 5,125,203 | 6/1992 | Daw | 52/241 |
| 5,245,811 | 9/1993 | Knorr | 52/238.1 X |
| 5,297,369 | 3/1994 | Dickinson | 52/145 X |

FOREIGN PATENT DOCUMENTS

| | | | |
|---|---|---|---|
| 8301327 | 11/1984 | Netherlands | 169/48 |
| 471258 | 9/1937 | United Kingdom | 52/785 |
| 541733 | 12/1941 | United Kingdom | 52/241 |
| 546880 | 8/1942 | United Kingdom | 52/145 |

*Primary Examiner*—Carl D. Friedman
*Assistant Examiner*—Laura A. Saladino
*Attorney, Agent, or Firm*—Michael, Best & Friedrich

[57] ABSTRACT

A fire resistant panel includes at least four parallel vertically extending sheets of gypsum. The sheets are fastened together in a spaced apart arrangement with two outer sheets and two inner sheets positioned between the outer sheets to define a member having first and second opposite vertically extending sides. Vertically extending sheets of steel are in contact with and cover both sides of the member. The upper support for the member defines a circuitous path from one side of the member to the other. A bottom seal is supported by the member and includes a weight mechanism attached to the bottom seal. The weight is pivotally movable and biases the bottom seal downwardly for engagement with a floor.

28 Claims, 8 Drawing Sheets

FIRE-RATED PANEL

FIELD OF THE INVENTION

The invention relates generally to partition arrangements including discrete panels suspended from an overhead track, which panels are moveable along the track.

BACKGROUND OF THE INVENTION

Operable partition arrangements are employed in hotels, clubs, convention halls, schools, offices, and any other location where it is desired to subdivide a large room space into smaller room spaces, either temporarily or for an extended period of time. The partition arrangements include discrete panels suspended from an overhead track, which panels are moveable along the track. The partition arrangements typically include a storage space into which the panels can be moved, along the track, for storage when it is not desired to subdivide the large room space.

It is desirable to provide such a panel that is fire resistant.

SUMMARY OF THE INVENTION

A problem with such partition arrangements is that flames from a fire can pass over the top of the panel, where the panel is supported from the ceiling. Another problem is that flames from a fire can pass through joints where one panel is slid into engagement with an adjacent panel, such as when a wall is formed using the panels. Another problem is that springs employed to bias a bottom seal into engagement with a floor below the partition can be adversely affected by a fire, which can result in the bottom of the panel being blown out away from the floor during a fire.

The invention provides a fire resistant partition arrangement. One embodiment of the invention provides a partition arrangement capable of withstanding a two hour UL (Underwriters Laboratories) fire test of the type intended for walls.

Other features and advantages of the invention will become apparent to those of ordinary skill in the art upon review of the following detailed description, claims, and drawings.

DETAILED DESCRIPTION OF THE PREFERRED EMBODIMENT OF THE INVENTION

Figure 1:
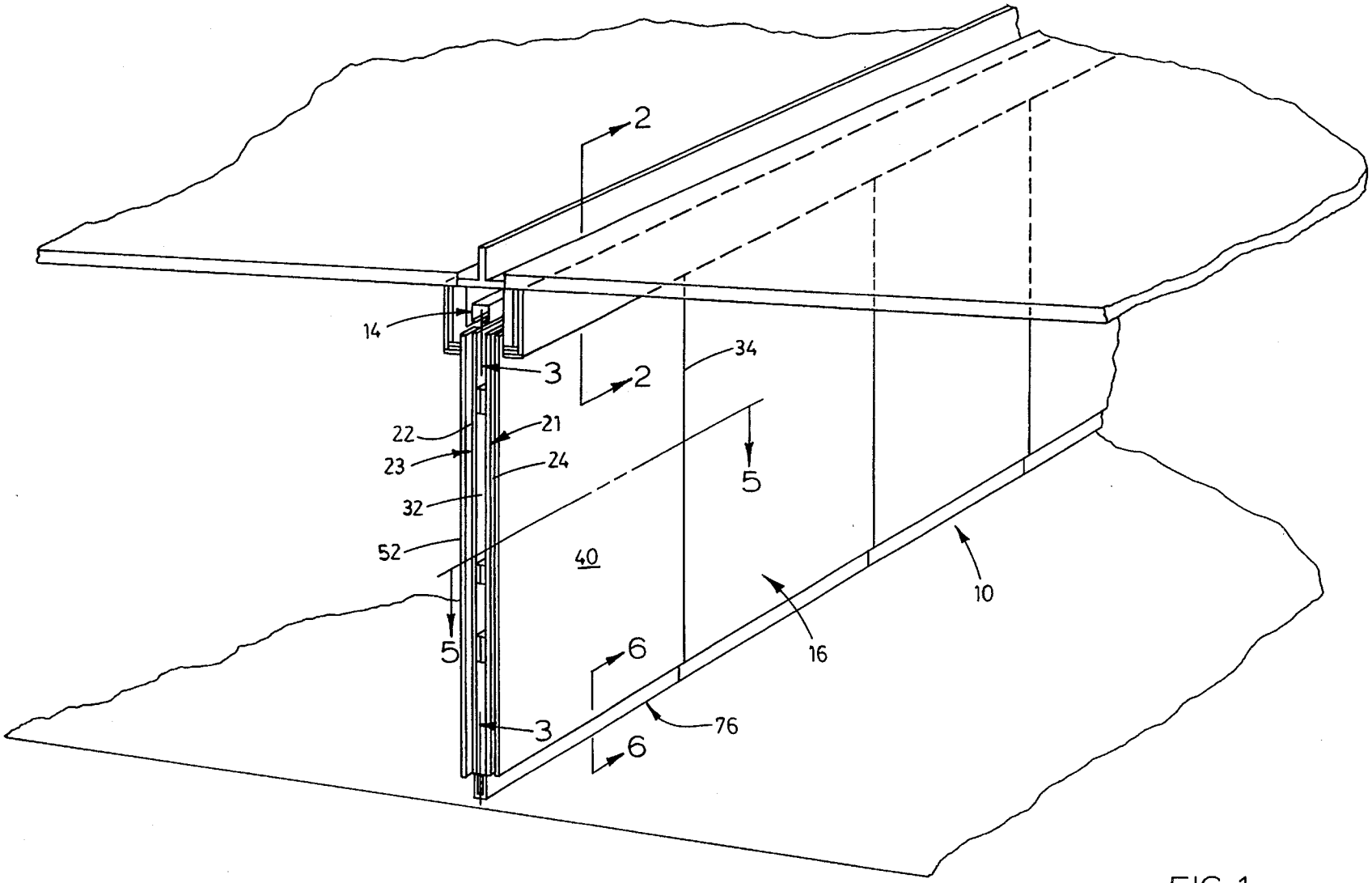
FIG. 1 is a perspective view, partially broken away, illustrating a partition arrangement embodying various feature of the invention.
Figure 2:
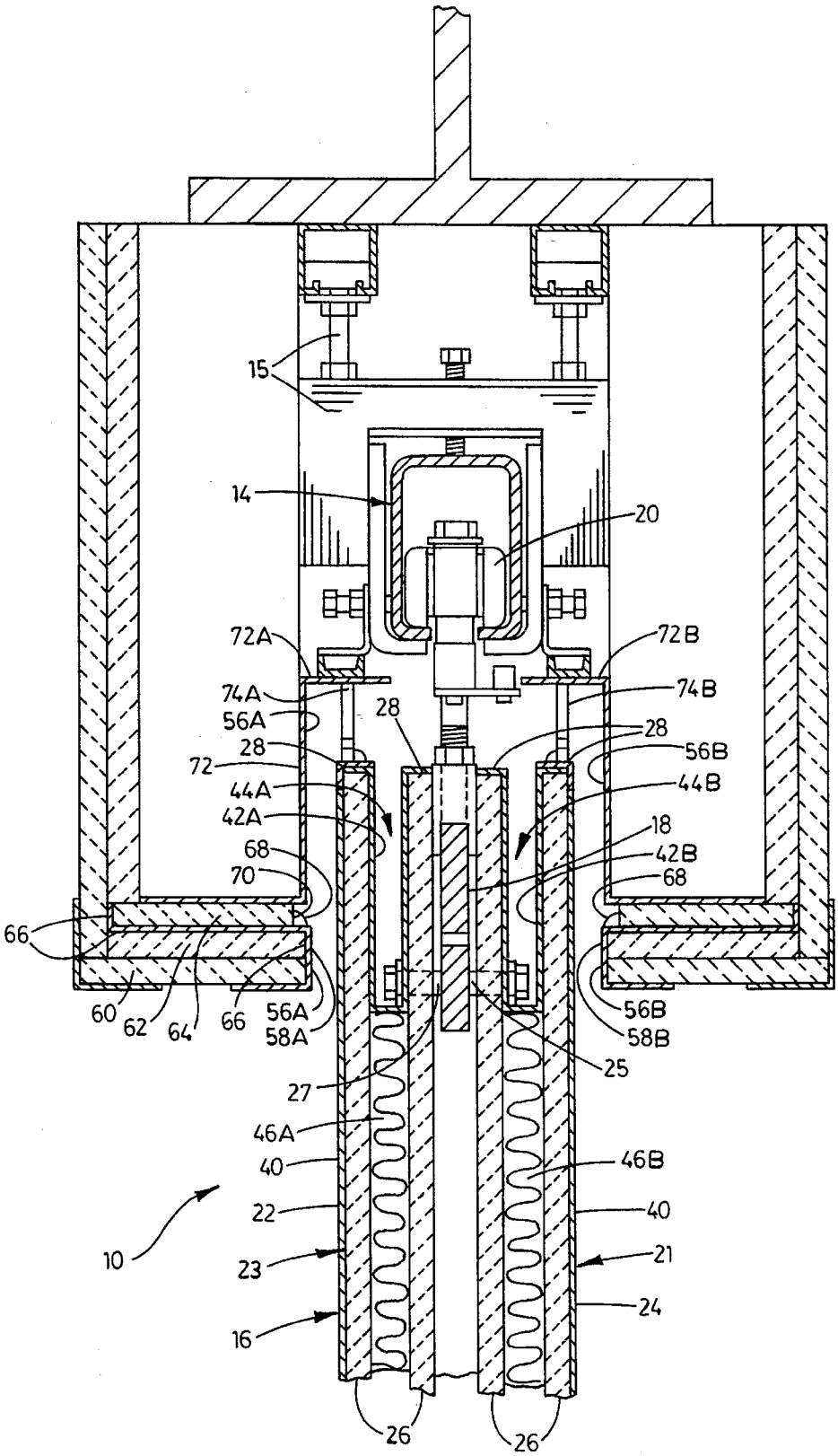
FIG. 2 is a partially broken away sectional view taken along line 2—2 of FIG. 1 and illustrating an upper portion of the partition arrangement of FIG. 1, including a top sealing arrangement.
Figures 3, 4:
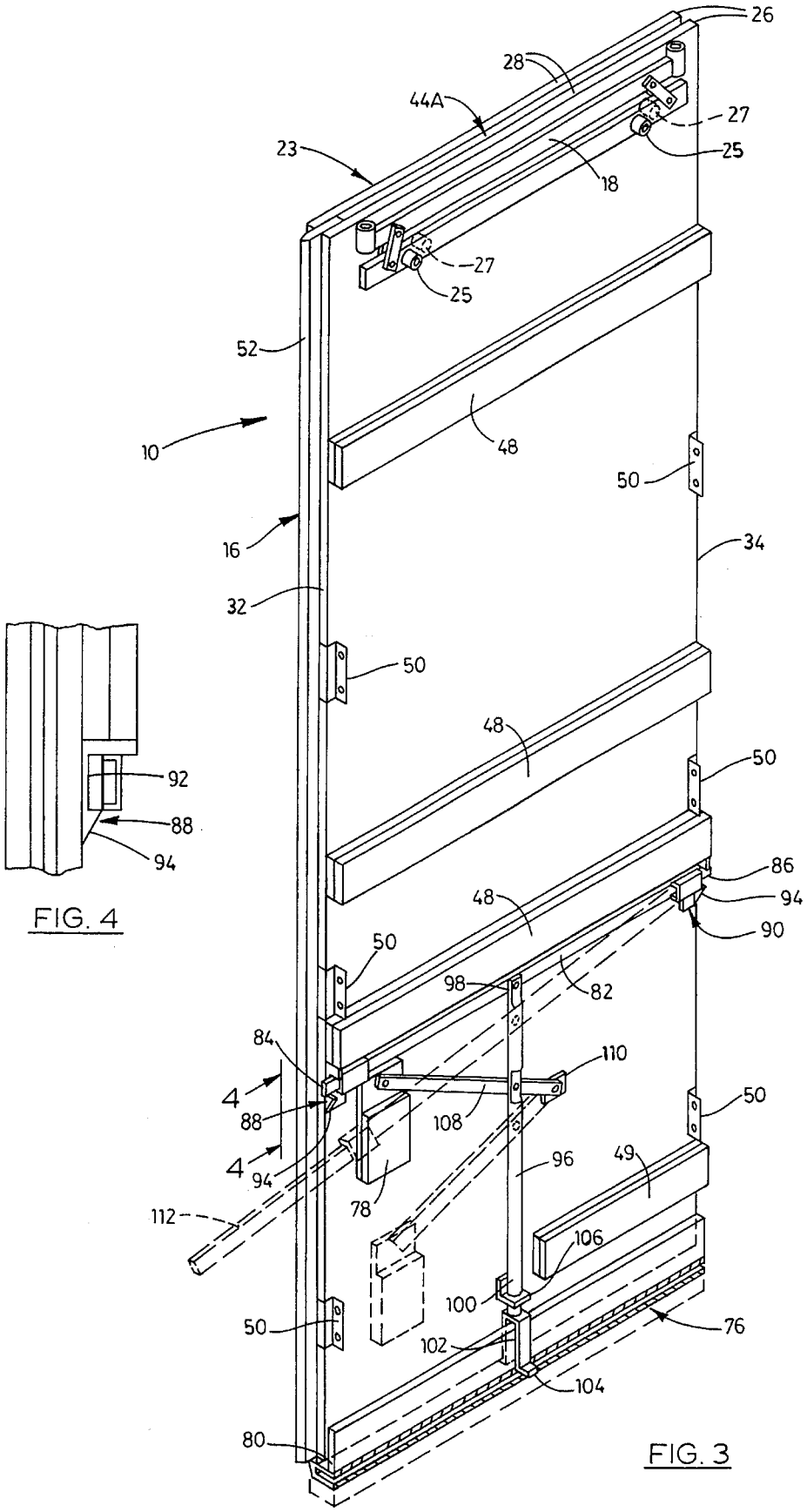
FIG. 3 is a sectional view taken along line 3—3 of FIG. 1 and showing a panel of the partition arrangement of FIG. 1 split open.
FIG. 4 is a broken away side view taken along line 4—4 of FIG. 3 showing a portion of a panel of the partition arrangement of FIG. 1.
Figure 3B:
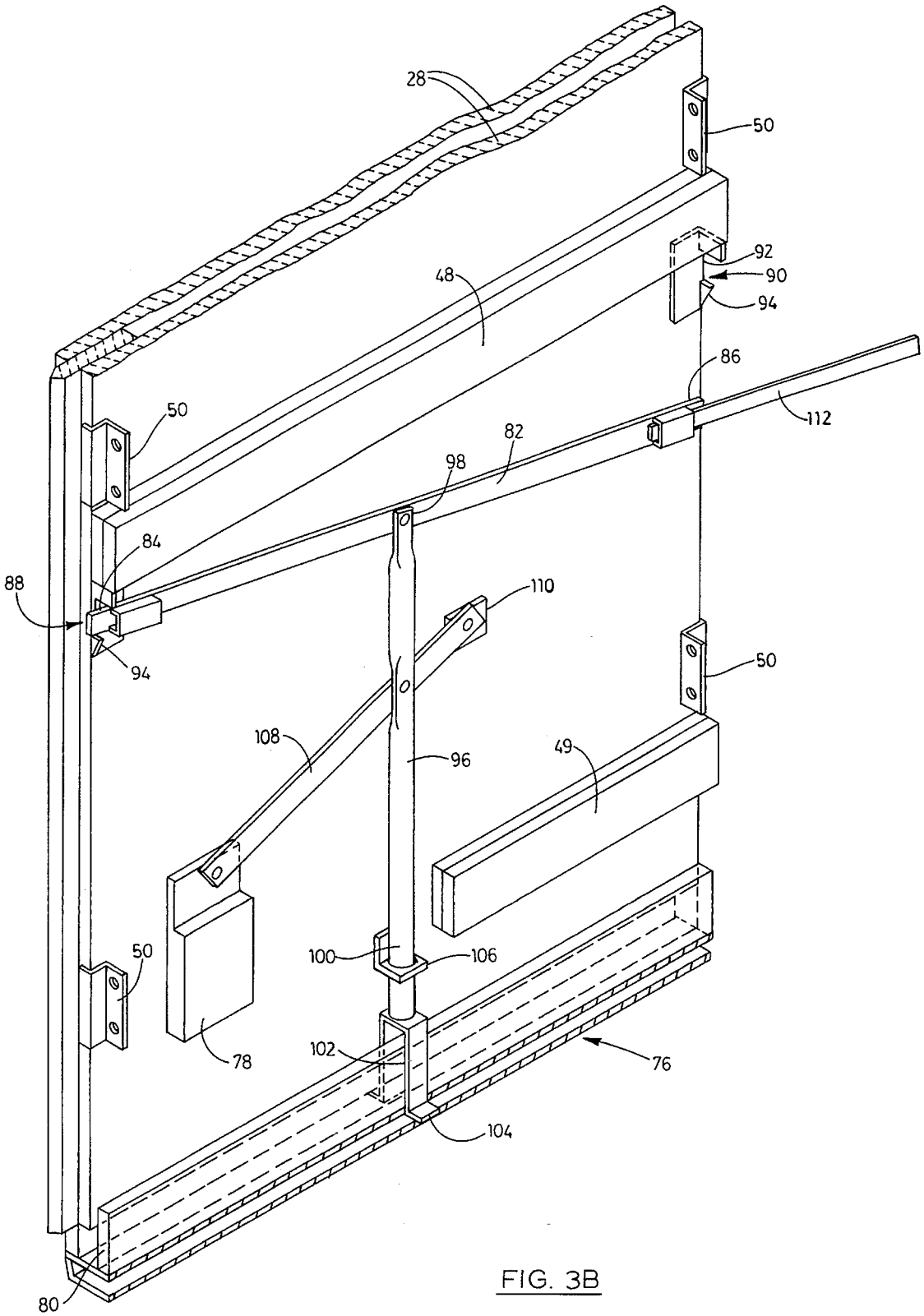
FIG. 3B is a sectional view similar to FIG. 3, but partially broken away and illustrating a weight mechanism operated from an opposite end of the panel.
Figure 5:
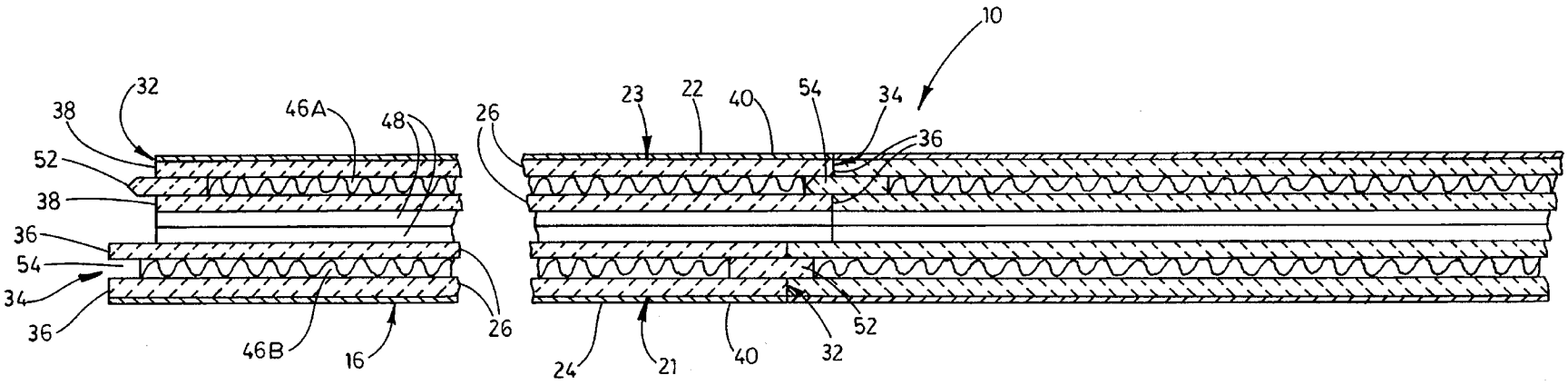
FIG. 5 is a sectional view taken along line 5—5 of FIG. 1 and illustrating a bottom portion of the partition arrangement of FIG. 1, including a bottom seal.
Figure 6:
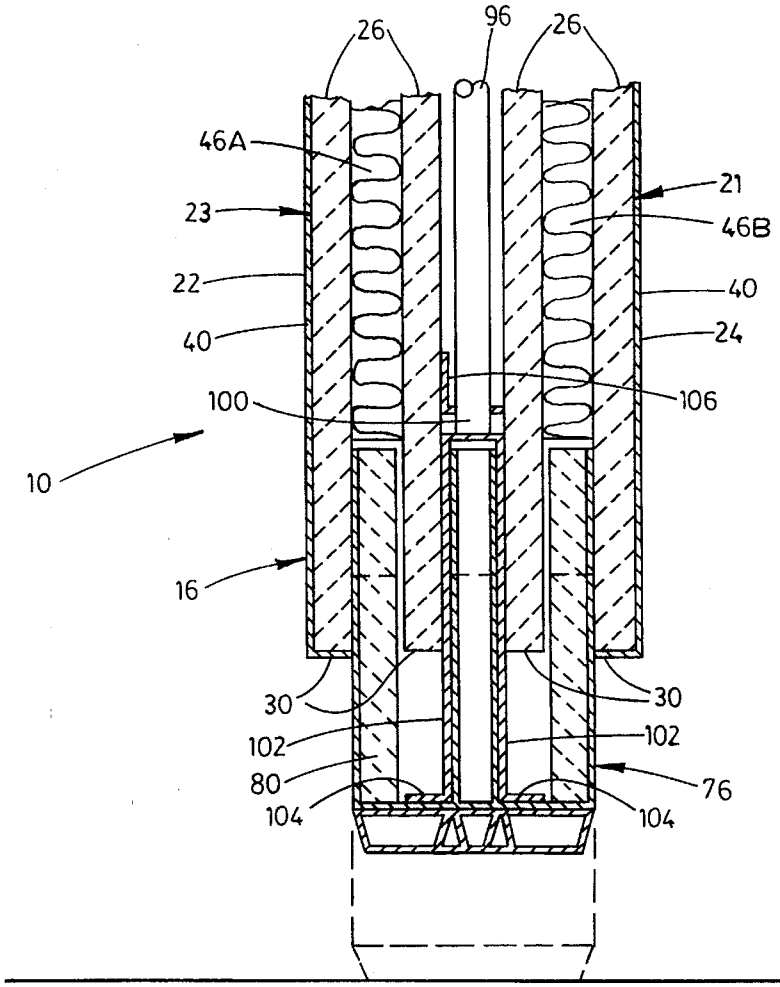
FIG. 6 is a sectional view taken along line 6—6 of FIG. 1, including a seal of a bottom sealing assembly included in the partition arrangement of FIG. 1.

Shown in the various figures is a partition arrangement 10 embodying various features of the invention. The partition arrangement 10 is intended to be used in rooms for selectively subdividing the room into smaller areas. The partition arrangement 10 includes a track 14, structure 15 for supporting the track 14 from a structural beam (e.g. from a ceiling beam), and a panel 16 supported by the track 14. While other arrangements could be employed, in the illustrated embodiment the panel 16 includes a steel top connecting bar 18 for connecting the panel 16 to a trolley or carrier 20 supported by the track 14 for rolling movement along the track 14 and for supporting the panel 16 from the carrier 20 for rolling movement along the track 14.

In the preferred embodiment, the panel 16 includes four generally planar parallel, spaced apart sheets 26 of wallboard, which sheets 26 are connected together. The term wallboard, as employed herein, is generally defined as any non-metal sheet material from which a wall can be made (e.g., gypsum, fiberboard, plywood or other wood, plasterboard, plaster, sheetrock, particleboard, or other materials). In the preferred embodiment, the sheets 26 of wallboard employed are fire resistant. More particularly, in the preferred embodiment, the sheets 26 of wallboard are sheets of gypsum. In the most preferred embodiment, the sheets 26 of wallboard are sheets of fire rated gypsum.

In the preferred embodiment, the panel 16 has exactly four sheets 26 of wallboard, with a first pair 21 of the sheets 26 of wallboard being located on one side of the top connecting bar 18 and a second pair 23 of the sheets 26 of wallboard being located on the other side of the top connecting bar 18. The top connecting bar 18 is bolted to a frame 42B (discussed below) through one sheet 26 of the first pair 21 of sheets 26 of wallboard at first locations 25 along the length of the top connecting bar 18, and the top connecting bar 18 is bolted to a frame 42A (discussed below) through one sheet 26 of the second pair 23 of sheets 26 of wallboard at second locations 27 along the length of the top connecting bar 18. The second locations 27 are spaced apart from the first locations 25 so that heat is not transmitted directly through all four sheets 26 of wallboard by a support bolt passing simultaneously through all four sheets 26 of wallboard.

Each sheet 26 is at least 0.25 inch thick. In a preferred embodiment, each sheet 26 is between 0.25 and 0.75 inch thick. In a most preferred embodiment, each sheet 26 is 0.5 inch thick. The sheets 26 each have a top 28 facing the track 14, a bottom 30 facing the floor of the room, and opposite ends 32 and 34. The sheets 26 have a height between the top 28 and bottom 30. The panel 16 has a width between the opposite ends 32 and 34, and a thickness in a horizontal direction which is perpendicular to the direction of movement of the panel 16.

The panel 16 further includes a vertically extending sheet 40 of metal in contact with and covering each of the two outwardly facing sides of the outside sheets 26. In the preferred embodiment, each sheet 40 of metal consists of a metal capable of withstanding heat. In the preferred embodiment, each sheet 40 of metal consists of steel. Each of the sheets 40 of steel has a thickness of 18 gage or a thickness of 21 gage. Thicker sheets 40 of metal may be employed, or additional sheets 40 of metal may be employed covering other of the sides of the sheets 26 of wallboard; however, it is to be understood that this will increase the weight of the panel 16.

The panel 16 further includes two perimeter steel frames 42A and 42B, on either side of the top connecting bar 18, at the top 28 of the panel. Each perimeter steel frame 42A and 42B extends downwardly from the tops of two adjacent wallboard sheets 26 into the space between the two adjacent wallboard sheets 26 to provide beam strength for supporting the weight of the panel 16. The panel 16 further comprises insulation, below each perimeter steel frame 42A and 42B, in the spaces 46A and 46B between the outermost wallboard sheets 26 and the intermediate wallboard sheets 26. This insulation is either mineral wool, fiberglass, or air, and provides acoustic insulation.

The panel 16 further comprises laterally extending spacers 48 which space the intermediate sheets apart from one another. In the illustrated embodiment, each spacer 48 comprises two strips of ⅝ inch thick strips of gypsum that extend along the width of the panel 16 and that are back to back so as to space the intermediate sheets 26 apart by 1¼ inch. The spacers are provided at various locations along the height of the panel 16. In the illustrated embodiment, the panel 16 further comprises an additional spacer 49, proximate the bottom of the panel 16, that extends in the direction of the width of the panel 16, but that does not extend across the entire width of the panel 16. The spacers advantageously space the intermediate sheets apart by more than an inch to provide room for a weight mechanism that will be described below.

In alternative embodiments, two sheets of wallboard can be employed with two sheets of metal (see FIGS. 7A and 7B) or four sheets of metal, four sheets of wallboard can be employed with four sheets of metal (see FIGS. 7C or 7D) or a different number of sheets of wallboard can be employed. In the preferred embodiment, the two intermediate sheets 26 of wallboard are spaced apart 1¼ inches, and the overall thickness of the panel is 2⅛ inches. In alternative embodiments, different spacings between adjacent sheets of wallboard can also be employed (see, for example, the difference in spacing between the embodiment shown in FIG. 7A and FIG. 7B).

Figure 7D:
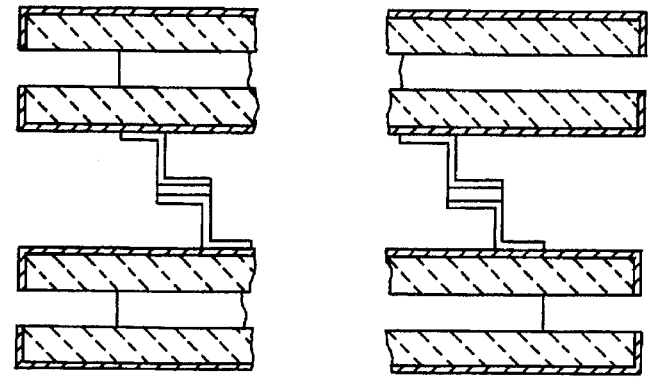
FIG. 7D is a broken away view, taken along a horizontal section plane, illustrating an alternative panel construction. The respective locations of protrusions and notches are reversed from FIGS. 1–6.
Figure 7C:
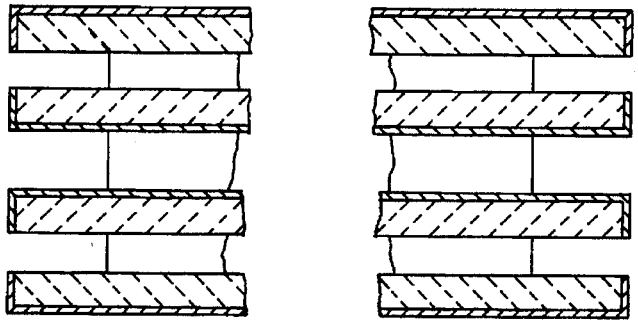
FIGS. 7A, 7B, and 7C are broken away cross sectional views, taken along a vertical section plane, illustrating alternative panel constructions.
Figure 7B:
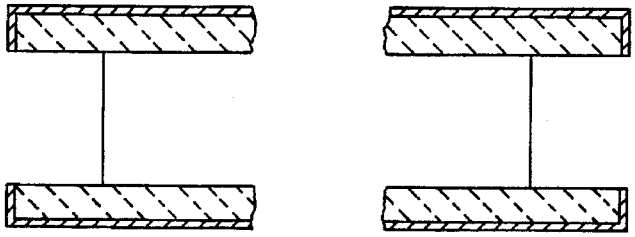
Figure 7A:
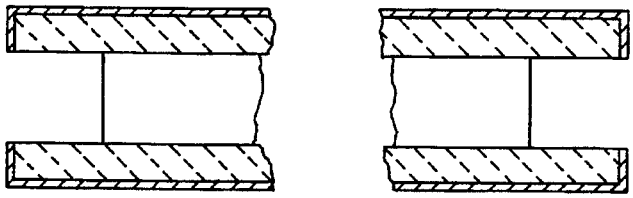

The panel 16 further comprises connectors 50, separate from the top connecting bar 18, which connect the wallboard sheets 26 together along the opposite ends of the wallboard sheets 26. Each connector 50 comprises two metal brackets bolted together with insulating material between the two metal brackets where they are bolted together, in the same manner as is shown in FIG. 7D.

The panel 16 has opposite sides 22 and 24 defined by the sheets of steel, and the thickness of the panel is the distance between these sides 22 and 24.

Each end 32 and 34 has two parallel, generally planar, edge surfaces 36 and 38 that extend along the height of the panel 16, that are offset from one another in the width direction, and that are each perpendicular to the side 22. The ends 32 and 34 of the panel 16 engage ends of adjacent panels when the panels are pushed together to define a wall. The end 32 of the panel 16 includes a protrusion 52 extending away from the edge 38 toward an adjacent panel. The protrusion 52 extends along the height of the panel, and is selectively received in a notch in an adjacent panel to define a joint with the adjacent panel when pushed into engagement with the adjacent panel. The end 32 of the panel 16 includes a notch 34 extending from the edge 36 into panel. The notch extends along the height of the adjacent panel and receives a protrusion from the adjacent panel.

Each end 32 and 34 of each panel 16 has both a protrusion 52 and an adjacent notch 54 for engagement with a notch 54 and protrusion 52 of an adjacent panel. Thus, each end 32 and 34 has two offset joining means for engagement with an adjacent panel. The protrusion and notch arrangement at one end 32 of the panel 16 is asymmetrical and complementary to the protrusion and notch arrangement at the other end 34 of the panel 16 so that if the panel 16 was rotated 180° about its height before installation, it would still engage adjacent panels. Preferably, each protrusion 52 is lined with steel.

By having two offset edges at each end 32 and 34, with both a notch and a protrusion at each end 32 and 34, travel of flames through joints between panels is impeded.

Figure 8:
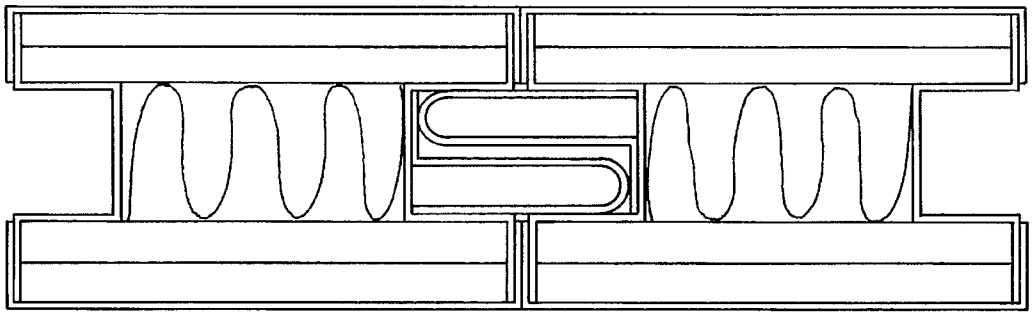
FIGS. 8, 9, and 10 are cross sectional views, taken along a horizontal section plane, illustrating alternative panel constructions and alternative joint arrangements.
Figure 9:
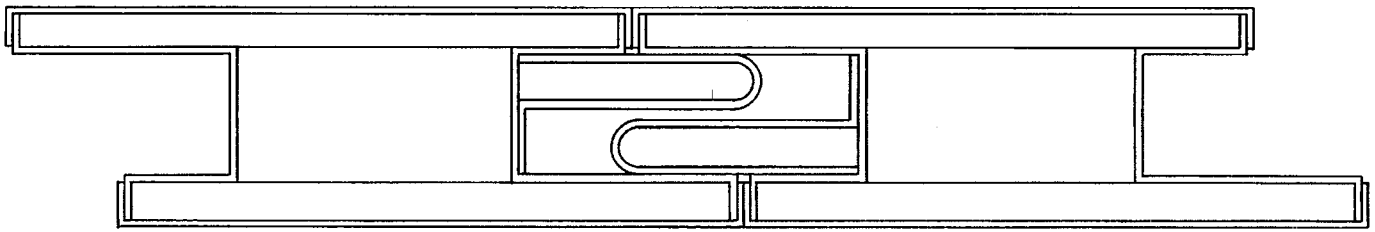
Figure 10:
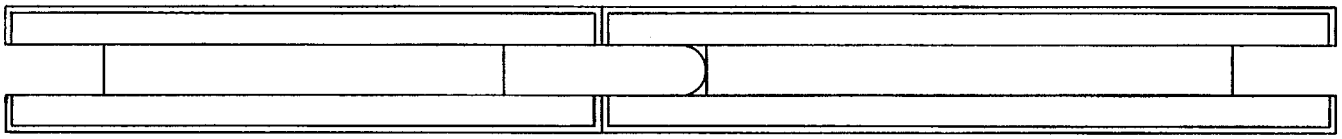
Figure 10:
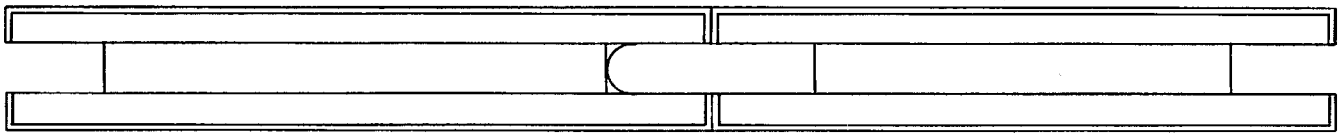

Alternative joint arrangements are illustrated in FIGS. 8–10.

It is to be understood that the illustrated panel 16 defines an intermediate portion of a wall, and that each of the panels that define the opposite ends of the wall may have one different (e.g. finished or flat) end 32 or 34. This is because these panels only need to form a joint at one of their ends 32 or 34.

The partition arrangement 10 further includes first and second parallel spaced apart surfaces 56A and 56B which extend vertically down, away from the ceiling, to below the top 28 of the panel 16, each of which faces a side of the panel 16 so as to prevent flames from a fire from travelling directly across the top of the panel 16. In the illustrated embodiment, each surface 56A and 56B extends vertically below the top of the panel 16. The lowermost portions 58A and 58B of the surfaces 56A and 56B are closely spaced from the sides of the panel 16. In the illustrated embodiment, the lowermost portion 58A and 58B of each surface 56A and 56B is horizontally spaced from the panel 16 by a distance that is less than the vertical extent of the surface 56A or 56B below the top 28 of the panel 16. More particularly, in the illustrated embodiment, each of the lowermost portions 58A and 58B of the surfaces 56A and 56B is horizontally spaced ½" from the side 22 or 24 of the panel 16 that the portion 58A or 58B faces.

Each surface 56A and 56B is made up of a combination of vertically and horizontally extending materials. For example, in the illustrated embodiment, each surface 56A and 56B includes sheets of wallboard, and metal (e.g. steel) covering the gypsum and facing the panel. In the illustrated embodiment, each lowermost portion 58A and 58B is made up of two adjacent, horizontally extending ⅝" thick sheets 60 and 62 of gypsum, a horizontally extending ½" thick sheet 64 of gypsum above and adjacent the upper ⅝" thick sheet 62 of gypsum, a generally U-shaped 20 gage steel member 66 covering edges of the two sheets of gypsum facing the panel, and intumescent material 68 on top of the sheet 62 of gypsum and covering the recessed edge 70 of the ½" thick sheet 64 of gypsum that faces the panel 16. The intumescent material 68 foams up during a fire and inhibits a flame from passing across the top 28 of the panel 16. In the illustrated embodiment, the intumescent material is a 3M product sold under the name "Fire Barrier CP 25N/S No-Sag Caulk". The surfaces 56A and 56B can be made up of various materials arranged in various ways. For example, in one embodiment, the surfaces 56A and 56B are made up of vertically extending sheets of gypsum.

The partition arrangement further includes a 20 gage steel member 72A, a portion of which extends laterally from the surface 56A, and a vinyl sweep seal 74A extending vertically upwardly from the top 28 of the panel 16, proximate one side 22 of the panel 16, to the laterally extending portion of steel member 72A. The partition arrangement further includes a second steel member 72B, a portion of which extends laterally from the surface 56B, and a second vinyl sweep seal 74B extending vertically upwardly from the top of the panel 16, proximate the other side 24 of the panel 16, to the second steel member 72B. The vinyl sweep seals 74A and 74B inhibit smoke and flame from travelling over the top 28 of the panel 16 for a period sufficient for activation of the intumescent material 68.

The illustrated panel further includes a bottom sealing assembly 76 including a moveable metal weight 78 housed between the intermediate wallboard sheets 26, and a seal 80 which extends at least partially below the bottom 30 of the wallboard sheets 26. The seal 80 is movably connected to the weight 78 and is selectively moved by the weight 78 into sealing engagement with the floor (or carpet) below the partition arrangement 10. The seal 80 includes vertically extending sheets of metal and wallboard (e.g. sheetrock) which are telescopically moveable in spaces between the sheets 26, and which are preferably connected together only at their bottoms so as to minimize transmission of heat from a fire through them. Prior partition arrangements have employed a spring for biasing a seal into engagement with a floor. Because such a spring can be adversely affected by fire, the partition arrangement 10 employs a weight instead. The bottom sealing assembly 76 advantageously inhibits the bottom of the panel 16 from being blown out, away from the floor, during a fire or during a UL hose stream test.

The weight 78 is moveable between a raised position, corresponding to the seal 80 not being biased toward the floor, and a lowered position, corresponding to the seal 80 being biased toward the floor. Means are provided for selectively moving the weight and seal between the raised and lowered positions, the means being accessible from either end 32 of the panel 16 and the means not extending out of the panel 16 past either end. More particularly, the means includes a crossbar 82 extending in the width direction and which is capable of pivoting at either end of the panel and which is engageable at either end of the panel. The crossbar 82 has opposite ends 84 and 86 defining sockets facing away from each other. The bottom sealing assembly includes a first support bracket 88 attached to one of the wallboard sheets 26 proximate its end 32, and a second support bracket 90 attached to the same sheet 26 proximate its other end 34. Each support bracket 88 and 90 is capable of providing a pivot point for the crossbar 82. Each support bracket 88 and 90 includes a horizontally extending support portion 92 which extends away from the sheet in the thickness direction and which vertically supports the crossbar 82, and a vertically upwardly extending hook portion 94 extending from the support portion 92 and which restricts the crossbar 82 against movement in the thickness direction unless one of the ends 84 or 86 of the crossbar 82 is raised, and then translated (in the thickness direction) out of engagement with the hook portion 94.

The bottom sealing assembly 76 further includes a vertically extending rod 96 having an upper portion 98 attached to the crossbar 82 between its ends 84 and 86 (preferably halfway between its ends 84 and 86), and having a lower end 100. The bottom sealing assembly 76 further includes an attachment member 102 in the general shape of clevis or a downwardly facing U attached to the seal 80, and having an intermediate portion connected to the lower end of the vertically extending rod 96, having spaced apart vertically extending planar tine portions on either side of a middle sheet of sheetrock of the bottom seal 80, and having lower lateral flanges 104 below the bottom of the sheets 26, which flanges are connected to a bottom metal frame member of seal 80, which bottom metal frame member is connected to the vertically extending metal sheets of the seal 80. The flanges 104 are directed away from one another below the wallboard sheets 26 and engage the wallboard sheets 26 to limit upward travel of the vertically extending rod 96 and therefor of the ends 84 and 86. The bottom sealing assembly further includes a guide 106 attached against the same sheet 26 to which the support brackets 88 and 90 are attached. The guide 106 surrounds the vertically extending rod 96 to restrict lateral movement of a lower portion of the vertically extending rod 96 and to guide the lower portion of the vertically extending rod 96 for substantially vertical movement relative to the guide 106 and to the wallboard sheets 26.

The bottom sealing assembly further includes a pivot arm 108 pivotally connected against the sheet 26 at a location 110 spaced, in the width direction, from the vertically extending rod 96 and spaced, in the vertical direction below the crossbar 82.

Preferably, the support brackets 88 and 90, guide 106, and the pivot arm 108 are all fastened, through the sheet 26, to the metal sheet 40.

In the preferred embodiment, the weight 78, crossbar 82, supports 88 and 90, pivot arm 108, vertically extending rod 96, guide 106, and attachment member 102 are made of metal and, more particularly, of steel, and are located between sheets 26. In a most preferred embodiment, these metal components are located between the two intermediate sheets 26, so that there are two sheets 26 on either side of these components.

Each of the opposite ends of the crossbar 82 is selectively engageable by a handle or bar 112.

In one embodiment of the invention, the four sheet panel 16 is manufactured by connecting together two panels of the type including two sheets of gypsum, with the weight, crossbar, supports, pivot arm and vertically extending rod inbetween, and by covering with respective sheets of metal the exposed sides (either before or after the sheets of gypsum are connected together).

Modifications may be made to the preferred embodiment described and illustrated herein without departing from the spirit of the invention as expressed in the following claims.

We claim:

1. A fire resistant panel adapted to be supported for movement along a track hanging from a structure, said panel comprising:

at least four parallel vertically extending sheets of gypsum, each sheet of gypsum being spaced apart from the adjacent sheet of gypsum and each sheet of gypsum having oppositely facing surfaces;

means for fastening said sheets of gypsum together in said spaced apart arrangement with two outer sheets and with two inner sheets positioned between said outer sheets to define a member having first and second opposite vertically extending sides which are parallel to the direction of movement of the panel and which sides are defined by the outer surfaces of said two outer sheets;

a vertically extending sheet of steel in contact with and covering one of said sides of said member; and a vertically extending sheet of steel in contact with and covering the other of said sides of said member; and the oppositely facing surfaces of said outer sheets are not covered by metal sheets.

2. A fire resistant panel as set forth in claim 1 wherein each of said sheets of gypsum have a thickness of ½ inch.

3. A fire resistant panel as set forth in claim 1 wherein each of said sheets of steel have a thickness of 18 gage.

4. A fire resistant panel as set forth in claim 1 wherein each of said sheets of steel have a thickness of 21 gage.

5. A fire resistant panel as set forth in claim 1 wherein one of said sheets of gypsum defines one of said sides of said member, and wherein another one of said sheets of gypsum defines the other of said sides of said member, and wherein said panel further comprises insulation separating each steel covered sheet of gypsum from the adjacent sheet of gypsum.

6. A fire resistant partition arrangement comprising:

a track supported from a structure; and a panel including:

a plurality of parallel vertically extending sheets of wallboard;

means for supporting said sheets of wallboard from said track for horizontal movement and for fastening said sheets of wallboard together with each sheet of wallboard parallel to and spaced apart from the adjacent sheet of wallboard to define a member having first and second opposite vertically extending sides that are both parallel to the direction of movement, and having a top and bottom;

a bottom seal supported by said member and moveable relative to said member between a raised position, and a lowered position in engagement with a floor below said member, at least a portion of said seal being telescopically slidable in one of the spaces between two of said sheets of wallboard;

a weight mechanism attached to said bottom seal and including a weight pivotally movable relative to at least one of said sheets of wallboard, said weight mechanism selectively biasing said bottom seal downwardly for engagement with a floor to impede movement of said panel along said track and in a direction perpendicular to said horizontal direction of movement along said track.

7. A fire resistant partition arrangement in accordance with claim 6 wherein said panel has opposite ends, each end being adapted to be selectively moved into engagement with the end of an adjacent panel, wherein said panel further comprises manually engagable means for pivoting said weight, said manually engageable means being accessible at both ends of said panel.

8. A fire resistant partition arrangement in accordance with claim 7 wherein said manually engageable means comprises a bar extending between the ends of the panel, said bar having opposite ends respectively facing out of the opposite ends of said panel, said bar being connected to said weight, said ends of said bar being alternatively engageable by a handle to move said weight.

9. A fire resistant partition arrangement in accordance with claim 8 wherein said bar is housed between two of said sheets of gypsum.

10. A fire resistant partition arrangement in accordance with claim 8 wherein said weight is moveable between a raised position corresponding to said bottom seal being in a raised position, and a lowered position corresponding to said bottom seal being biased downwardly into engagement with the floor, wherein said manually engageable means comprises a first support proximate one end of said panel and a second support proximate the other end of said panel, wherein said bar is supported by both said first and second supports when said weight is in its raised position, wherein said bar is pivotally moveable about a selectable one of said first and second supports, and wherein pivotal movement of said bar results in movement of said weight.

11. A fire resistant partition arrangement in accordance with claim 8 wherein said weight is moveable between a raised position corresponding to said bottom seal being in a raised position, and a lowered position corresponding to said bottom seal being biased downwardly into engagement with the floor, wherein said manually engageable means comprises a first support proximate one end of said panel and a second support proximate the other end of said panel, wherein said bar is supported by both said first and second supports when said weight is in its raised position, wherein said bar is selectively disengagable from a selectable one of said first and second supports, via the end of said panel closest to the selected one of said first and second supports, and said bar is pivotally moveable about the other of said first and second supports, and wherein pivotal movement of said bar causes movement of said weight.

12. A fire resistant partition arrangement comprising:

a track; and a panel including at least four parallel vertically extending sheets of gypsum, and means for supporting said sheets of gypsum from said track for horizontal movement and for fastening said sheets of gypsum together with each sheet of gypsum parallel to and spaced apart from the adjacent sheet of gypsum to define a member having first and second opposite vertically extending sides that are both parallel to the direction of movement, said supporting means comprising a metal top connecting bar supported by said track and fastened to said sheets of gypsum, said top connecting bar having a length in the horizontal direction and having opposite sides each parallel to the horizontal direction, a first pair of said sheets of gypsum being located on one side of said top connecting bar and a second pair of said sheets of gypsum being located on the other side of said top connecting bar, said top connecting bar being bolted to one sheet of said first pair of said sheets of gypsum at first locations along the length of said top connecting bar, and said top connecting bar being bolted to one sheet of said second pair of said sheets of gypsum at second locations along the length of said top connecting bar which second locations are spaced apart from said first locations so that heat is not transmitted directly through said four sheets of gypsum via a support bolt passing simultaneously through said four sheets, said panel further comprising a vertically extending sheet of steel in contact with and covering one of said sides of said member and a vertically extending sheet of steel in contact with and covering the other of said sides of said member.

13. A fire resistant partition arrangement in accordance with claim 12 and further comprising a bottom seal supported by said sheets of gypsum and moveable relative to said sheets of gypsum between a raised position, and a lowered position in engagement with a floor below said member, at least a portion of said seal being telescopically slidable in one of the space between two of said sheets of gypsum.

14. A fire resistant partition arrangement comprising:

a track; and a panel including at least four parallel vertically extending sheets of gypsum, and means for supporting said sheets of gypsum from said track for horizontal movement and for fastening said sheets of gypsum together with each sheet of gypsum parallel to and spaced apart from the adjacent sheet of gypsum to define a member having first and second opposite vertically extending sides that are both parallel to the direction of movement, said supporting means comprising a metal top connecting bar supported by said track and fastened to said sheets of gypsum, said top connecting bar having a length in the horizontal direction and having opposite sides each parallel to the horizontal direction, a first pair of said sheets of gypsum being located on one side of said top connecting bar and a second pair of said sheets of gypsum being located on the other side of said top connecting bar, said top connecting bar being bolted to one sheet of said first pair of said sheets of gypsum at first locations along the length of said top connecting bar, and said top connecting bar being bolted to one sheet of said second pair of said sheets of gypsum at second locations along the length of said top connecting bar which second locations are spaced apart from said first locations so that heat is not transmitted directly through said four sheets of gypsum via a support bolt passing simultaneously through said four sheets, said panel further comprising a vertically extending sheet of steel in contact with and covering one of said sides of said member and a vertically extending sheet of steel in contact with and covering the other of said sides of said member, a bottom seal supported by said sheets of gypsum and moveable relative to said sheets of gypsum between a raised position, and a lowered position in engagement with a floor below said member, at least a portion of said seal being telescopically slidable in one of the space between two of said sheets of gypsum and a weight mechanism attached to said bottom seal and including a weight pivotally connected through at least one of said sheets of gypsum, said weight mechanism selectively biasing said bottom seal downwardly for engagement with a floor to impede movement of said panel.

15. A fire resistant panel adapted to be supported for movement along a track hanging from a ceiling, said panel comprising:

at least four parallel vertically extending sheets of wallboard, each sheet of wallboard being spaced apart from the adjacent layer of wallboard and each sheet of wallboard having oppositely facing surfaces;

means for fastening said sheets of wallboard together in said spaced apart arrangement with two outer sheets and with two inner sheets positioned between said outer sheets to define a member having first and second opposite vertically extending sides which are parallel to the direction of movement of the panel and which sides are defined by the outer surfaces of said two outer sheets;

a vertically extending sheet of steel in contact with and covering one of said sides of said member; and a vertically extending sheet of steel in contact with and covering the other of said sides of said member;

the oppositely facing surfaces of said outer sheets not covered by metal sheets, said panel having opposite ends, each end being adapted to be selectively moved into engagement with the end of an adjacent panel, one of said ends including first and second vertically extending edge surfaces that are offset from one another in the width direction and that are each perpendicular to said first side, said one end including a vertically extending protrusion extending from said first edge away from said panel toward an adjacent panel, and said one end further including a vertically extending notch extending from said second edge into said panel, said notch and protrusion selectively engaging a protrusion and notch, respectively, of an adjacent panel to define offset joints between adjacent panels, whereby flames from a fire are inhibited from passing though joints between panels.

16. A fire resistant panel in accordance with claim 15 wherein said protrusion is lined with steel.

17. A fire resistant panel in accordance with claim 15 wherein both of said ends of said panel include said offset edge surfaces, said protrusion, and said notch, and wherein said ends are asymmetrical and complementary about a plane perpendicular to the direction of movement of said panel.

18. A fire resistant panel adapted to be supported for movement along a track, said panel comprising:

at least four parallel vertically extending sheets of gypsum, each sheet of gypsum being spaced apart from the adjacent layer of gypsum and each sheet of gypsum having oppositely facing surfaces;

means for fastening said sheets of gypsum together in said spaced apart arrangement with two outer sheets and with two inner sheets positioned between said outer sheets to define a member having first and second opposite vertically extending sides which are parallel to the direction of movement of the panel and which sides are defined by the outer surfaces of said two outer sheets;

a vertically extending sheet of steel in contact with and covering one of said sides of said member; and a vertically extending sheet of steel in contact with and covering the other of said sides of said member;

the oppositely facing surfaces of said outer sheets are not covered by metal sheets, said panel having opposite ends, each end being adapted to be selectively slid into engagement with the end of an adjacent panel, each end including first and second, vertically extending edge surfaces that are offset from one another in the width direction, said ends being asymmetrical and complementary about a plane perpendicular to the direction of movement of said panel.

19. A fire resistant partition arrangement comprising:

a track;

a panel including:

a plurality of parallel vertically extending sheets of wallboard and each sheet having planar, oppositely facing surfaces;

means for supporting said sheets of wallboard from said track for horizontal movement and for fastening said sheets of wallboard together with each sheet of wallboard parallel to and spaced apart from the adjacent sheet of wallboard to define a member having first and second opposite vertically extending sides that are both parallel to the direction of movement, first and second sides having a top and bottom being planar from top to bottom;

a vertically extending sheet of steel in contact with and covering one of said sides of said member; and a vertically extending sheet of steel in contact with and covering the other of said sides of said member; and said partition arrangement further comprising a top housing including a first vertical surface on one side of said track and a second vertical surface on the other side of said track, said first and second surfaces of said top housing extending vertically down from above the top of said panel to below the top of the panel, whereby said first and second surfaces of said top housing are positioned respectively in opposed, horizontal spaced relationship to said first and second sheets of steel so as to prevent flames from a fire from travelling directly across the top of the panel.

20. A fire resistant partition arrangement in accordance with claim 19 wherein said first vertical surface of said top housing is spaced apart from the panel by a distance less than one inch.

21. A fire resistant partition arrangement in accordance with claim 20 wherein said second vertical surface of said top housing is spaced apart from the panel by a distance less than one inch.

22. A fire resistant partition arrangement in accordance with claim 20 wherein said first vertical surface of said top housing is spaced apart from the panel by one half of one inch.

23. A fire resistant partition arrangement in accordance with claim 19 wherein said first vertical surface of said top housing is spaced apart from the panel by one half of one inch.

24. A fire resistant partition arrangement in accordance with claim 19 wherein each said sheet of wallboard comprises a sheet of gypsum.

25. A fire resistant partition arrangement in accordance with claim 24 wherein each of said first and second vertical surfaces of said top housing comprises gypsum and steel covering that gypsum and facing the panel.

26. A fire resistant partition arrangement in accordance with claim 19 and further comprising intumescent material supported by said top housing.

27. A partition arrangement in accordance with claim 19 and further comprising a bottom seal supported by said member and moveable relative to said member between a raised position, and a lowered position in engagement with a floor below said member, at least a portion of said seal being telescopically slidable in one of the spaces between two of said sheets of wallboard.

28. A partition arrangement comprising a track;

a panel including:

a plurality of parallel vertically extending sheets of wallboard;

means for supporting said sheets of wallboard from said track for horizontal movement and for fastening said sheets of wallboard together with each sheet of wallboard parallel to and spaced apart from the adjacent sheet of wallboard to define a member having first and second opposite vertically extending sides that are both parallel to the direction of movement, and having a top and bottom;

a vertically extending sheet of steel in contact with and covering one of said sides of said member; and a vertically extending sheet of steel in contact with and covering the other of said sides of said member; and said partition arrangement further comprising a top housing including a first vertical surface on one side of said track and a second vertical surface on the other side of said track, said first and second surfaces of said top housing extending vertically down from above the top of said panel to below the top of the panel, said first and second surfaces of said top housing respectively facing said first and second sheets of steel so as to prevent flames from a fire from travelling directly across the top of the panel, a bottom seal supported by said member and moveable relative to said member between a raised position, and a lowered position in engagement with a floor below said member, at least a portion of said seal being telescopically slidable in one of the spaces between two of said sheets of wallboard, and a weight mechanism attached to said bottom seal and including a weight pivotally movable relative to at least one of said sheets of wallboard, said weight mechanism selectively biasing said bottom seal downwardly for engagement with a floor to impede movement of said panel along said track.

* * * * *